US007891423B2

(12) United States Patent
Dykstra

(10) Patent No.: US 7,891,423 B2
(45) Date of Patent: Feb. 22, 2011

(54) SYSTEM AND METHOD FOR OPTIMIZING GRAVEL DEPOSITION IN SUBTERRANEAN WELLS

(75) Inventor: Jason D. Dykstra, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 30 days.

(21) Appl. No.: 12/426,606

(22) Filed: Apr. 20, 2009

(65) Prior Publication Data

US 2010/0263861 A1 Oct. 21, 2010

(51) Int. Cl.
*E21B 47/09* (2006.01)
*E21B 43/04* (2006.01)

(52) U.S. Cl. ..... 166/253.1; 166/51; 166/53; 166/278

(58) Field of Classification Search ..... 166/278, 166/51, 53, 250.15, 253.1
See application file for complete search history.

(56) References Cited

U.S. PATENT DOCUMENTS 4,046,198 A * 9/1977 Gruesbeck et al. ..... 166/278
4,587,423 A 5/1986 Boyce
5,058,677 A * 10/1991 Forrest ..... 166/278
6,002,985 A * 12/1999 Stephenson ..... 702/13
6,554,064 B1 * 4/2003 Restarick et al. ..... 166/250.01
6,581,688 B2 * 6/2003 Voll et al. ..... 166/278
6,684,951 B2 * 2/2004 Restarick et al. ..... 166/250.01
6,935,424 B2 * 8/2005 Lehman et al. ..... 166/250.1
7,140,437 B2 11/2006 McMechan et al.
7,270,141 B2 9/2007 Dykstra
7,308,379 B2 12/2007 Dykstra et al.
7,316,272 B2 * 1/2008 Hurst et al. ..... 166/255.1
7,353,874 B2 4/2008 Dykstra et al.
7,356,427 B2 4/2008 Dykstra et al.
7,392,113 B2 6/2008 Dykstra
7,398,680 B2 * 7/2008 Glasbergen et al. ..... 73/152.12
7,415,364 B2 8/2008 Mazrooee et al.
7,433,762 B2 10/2008 Dykstra
7,494,263 B2 2/2009 Dykstra et al.
7,516,793 B2 4/2009 Dykstra
7,543,645 B2 6/2009 Dykstra et al.
2005/0092488 A1 5/2005 Rodet et al.
2007/0153622 A1 7/2007 Dykstra et al.
2007/0153623 A1 7/2007 Dykstra et al.

(Continued)

OTHER PUBLICATIONS

UK Combined Search and Examination Report, Jul. 1, 2010.

*Primary Examiner*—Jennifer H Gay
(74) *Attorney, Agent, or Firm*—Lawrence R. Youst

(57) ABSTRACT

A system for optimizing gravel deposition in a completion interval of a well. The system includes a pumping system that is operable to deliver a gravel pack slurry to the completion interval, an actuator system that is operable to control properties of the gravel pack slurry and a sensor system that is operable to monitor parameters representative of gravel deposition in the completion interval. A dynamic gravel pack model defined in a computer is operable to receive data from the sensor system and provides estimates of gravel deposition in the completion interval. A control system is operable to control the pumping system and the actuator system in relation to a gravel pack deposition plan and the dynamic gravel pack model, wherein the estimates of the dynamic gravel pack model are input into the control system to automatically modify the gravel pack deposition plan.

14 Claims, 6 Drawing Sheets

U.S. PATENT DOCUMENTS

2007/0153624 A1 7/2007 Dykstra et al.
2007/0171765 A1 7/2007 Dykstra et al.
2008/0065362 A1* 3/2008 Lee et al. ..... 703/10
2008/0084783 A1 4/2008 Mazrooee et al.
2008/0164021 A1* 7/2008 Dykstra ..... 166/250.1
2008/0165612 A1 7/2008 Dykstra
2008/0165613 A1 7/2008 Dykstra
2008/0179056 A1 7/2008 Dykstra
2008/0183310 A1 7/2008 Dykstra
2008/0183336 A1 7/2008 Dykstra
2008/0183415 A1 7/2008 Dykstra
2008/0236818 A1 10/2008 Dykstra
2009/0114386 A1* 5/2009 Hartog et al. ..... 166/250.08
2010/0263861 A1* 10/2010 Dykstra ..... 166/250.01

* cited by examiner

SYSTEM AND METHOD FOR OPTIMIZING GRAVEL DEPOSITION IN SUBTERRANEAN WELLS

TECHNICAL FIELD OF THE INVENTION

This invention relates, in general, to controlling sand production in subterranean wells that traverse fluid bearing formations and, in particular, to systems and methods for real time and automatic control of gravel packing operations to optimize gravel deposition in the well.

BACKGROUND OF THE INVENTION

Without limiting the scope of the present invention, its background is described with reference to the production of hydrocarbons through a wellbore traversing an unconsolidated or loosely consolidated subterranean formation, as an example.

It is well known in the subterranean well drilling and completion arts that particulate materials such as sand may be produced during the production of hydrocarbons from a well traversing an unconsolidated or loosely consolidated subterranean formation. Numerous problems may occur as a result of the production of such particulate. For example, the particulate causes abrasive wear to components within the well, such as tubing, fluid flow control devices, safety devices and the like. In addition, the particulate may partially or fully clog the well creating the need for an expensive workover. Also, if the particulate matter is produced to the surface, it must be removed from the hydrocarbon fluids by processing equipment on the surface.

One method for preventing the production of such particulate material to the surface is gravel packing the well adjacent the unconsolidated or loosely consolidated production interval. In a typical gravel pack completion, sand control screens are lowered into the wellbore on a work string to a position proximate the desired production interval. A fluid slurry including a liquid carrier and a particulate material known as gravel is then pumped down the work string and into the well annulus formed between the sand control screens and the perforated well casing or open hole production zone. Typically, the liquid carrier is returned to the surface by flowing through the sand control screens and up a wash pipe. The gravel is deposited around the sand control screens to form a gravel pack, which is highly permeable to the flow of hydrocarbon fluids but blocks the flow of the particulate carried in the hydrocarbon fluids. As such, gravel packs can successfully prevent the problems associated with the production of particulate materials from the formation.

It has been found, however, that a complete gravel pack of the desired production interval is difficult to achieve particularly in long production intervals that are inclined, deviated or horizontal. One technique used to pack a long production interval that is inclined, deviated or horizontal is the alpha-beta gravel packing method. In this method, the gravel packing operation starts with the alpha wave depositing gravel on the low side of the wellbore progressing from the near end to the far end of the production interval. Once the alpha wave has reached the far end, the beta wave phase begins wherein gravel is deposited in the high side of the wellbore, on top of the alpha wave deposition, progressing from the far end to the near end of the production interval.

It has been found, however, that as the desired length of horizontal formations increases, it becomes more difficult to achieve a complete gravel pack even using the alpha-beta technique. Therefore, a need has arisen for an improved apparatus and method for gravel packing a long production interval that is inclined, deviated or horizontal. A need has also arisen for such an improved apparatus and method that achieve a complete gravel pack of such production intervals. Further, a need has arisen for such an improved apparatus and method that provide for automatic control over the gravel deposition process in real time.

SUMMARY OF THE INVENTION

The present invention disclosed herein is a system and method for optimizing gravel deposition in a subterranean well. The system and method of the present invention improve the efficiency of gravel packing in long production intervals including inclined, deviated and horizontal production intervals. In addition, the system and method of the present invention are operable to repeatably achieve complete gravel packs of such production intervals while reducing the occurrence of bridging Further, the system and method of the present invention provide for automatic control over the gravel deposition process in real time.

In one aspect, the present invention is directed to a system for optimizing gravel deposition in a completion interval of a well. The system includes a pumping system that is operable to deliver a gravel pack slurry to the completion interval, an actuator system that is operable to control properties of the gravel pack slurry and a sensor system that is operable to monitor parameters representative of gravel deposition in the completion interval. A dynamic gravel pack model is defined in a computer that is operable to receive data from the sensor system and provide estimates of gravel deposition in the completion interval. A control system is operable to control the pumping system and the actuator system in relation to a gravel pack deposition plan and the dynamic gravel pack model, wherein the gravel deposition estimates of the dynamic gravel pack model are input into the control system to automatically modify the gravel pack deposition plan.

In one embodiment, the actuator system includes one or more of an actuator relating to establishing the sand concentration of the gravel pack slurry, an actuator relating to establishing the viscosity of the gravel pack slurry and an actuator relating to inputting at least one liquid additive into the gravel pack slurry. In one embodiment, the sensor system includes at least one of a surface sensor and a downhole sensor. In another embodiment, the sensor system includes at least one of a pressure sensor and a fluid flow rate sensor.

In one embodiment, the dynamic gravel pack model includes a fluid behavior model, a mass conservation model and a gravel deposition model. In another embodiment, the dynamic gravel pack model includes a time based and location based description of gravel deposition in the completion interval. In yet another embodiment, the gravel deposition estimates of the dynamic gravel pack model are automatically error corrected based upon data from the sensor system. In one embodiment, the gravel pack deposition plan includes a time based and location based description of the desired gravel deposition in the completion interval.

In another aspect, the present invention is directed to a method for optimizing gravel deposition in a completion interval of a well. The method includes pumping a gravel pack slurry into the completion interval; monitoring parameters representative of gravel deposition in the completion interval; estimating gravel deposition in the completion interval in a dynamic gravel pack model based at least in part upon the monitored parameters; and automatically modifying a first gravel pack deposition plan implemented by a control system that controls the composition and pumping of the gravel pack slurry based upon the gravel deposition estimates of the dynamic gravel pack model.

The method may also include monitoring the parameters with at least one of a surface sensor and a downhole sensor; monitoring at least one of a pressure sensor and a fluid flow rate sensor; modeling fluid behavior, mass conservation and gravel deposition in the dynamic gravel pack model; automatically correcting errors in the model based upon the monitored parameters; developing a time based and location based description of gravel deposition in the completion interval in a dynamic gravel pack model; developing a time based and location based description of the desired gravel deposition in the completion interval in a gravel pack deposition plan and automatically implementing a second gravel pack deposition plan if the gravel deposition estimates of the dynamic gravel pack model deviate from the first gravel pack plan by a predetermined amount.

In a further aspect, the present invention is directed to a system for optimizing gravel deposition in a completion interval of a well. The system includes a pumping system that is operable to deliver a gravel pack slurry to the completion interval, an actuator system that is operable to control properties of the gravel pack slurry and a downhole sensor system operable to monitor parameters representative of gravel deposition in the completion interval. A downhole dynamic gravel pack model defined in a downhole computer is operable to receive data from the sensor system and provide estimates of gravel deposition in the completion interval. A surface dynamic gravel pack model defined in a surface computer is operable to receive estimates from the downhole dynamic gravel pack model and provide estimates of gravel deposition in the completion interval. A control system is operable to control the pumping system and the actuator system in relation to a gravel pack deposition plan and the dynamic gravel pack models, wherein the gravel deposition estimates of the surface dynamic gravel pack model are input into the control system to automatically modify the gravel pack deposition plan.

In one embodiment, the downhole sensor system includes at least one of a pressure sensor, a viscosity sensor, a temperature sensor, a velocity sensor, a specific gravity sensor, a conductivity sensor and a fluid composition sensor.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
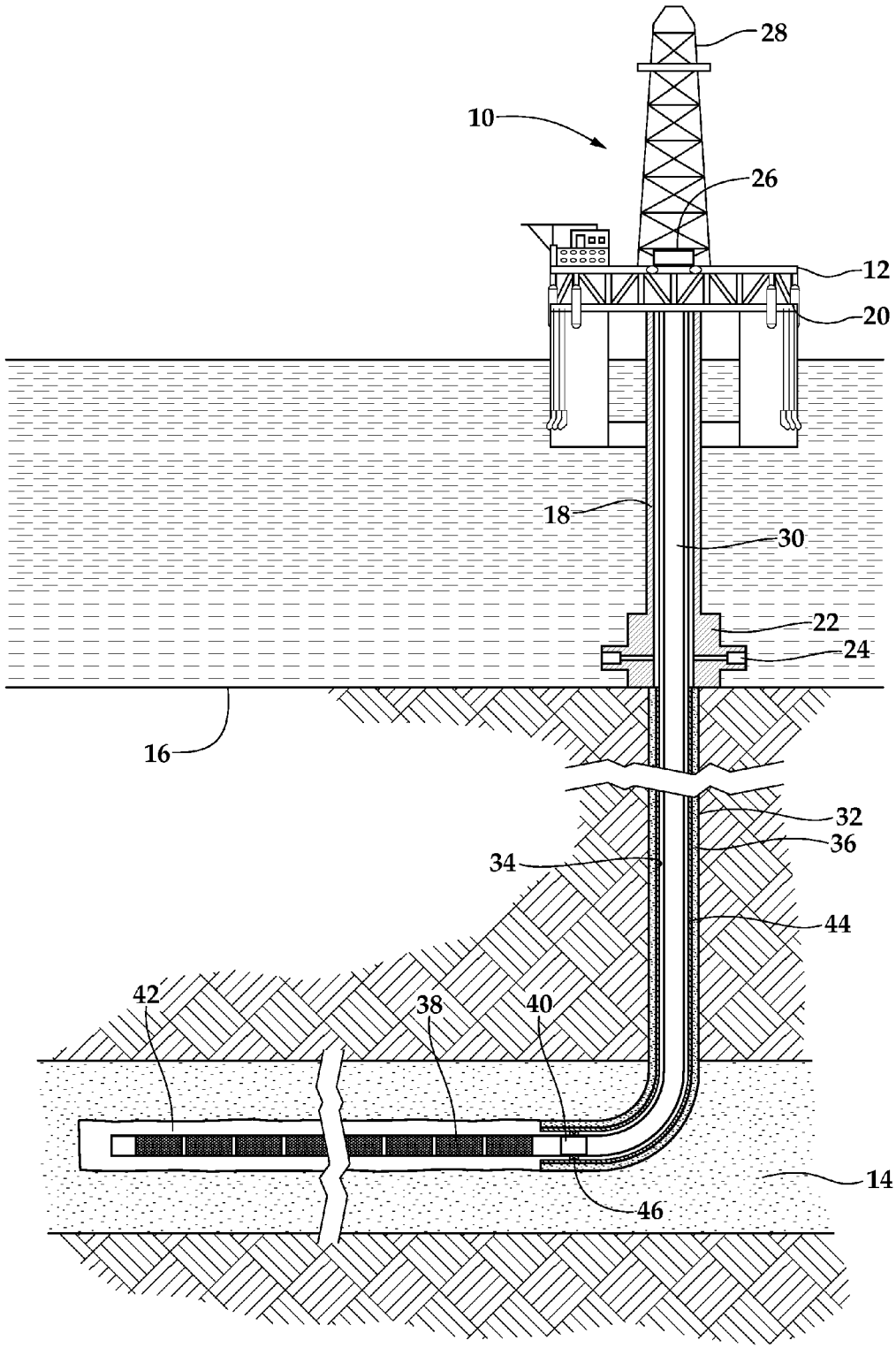
FIG. 1 is a schematic illustration of an offshore oil and gas platform operating a system for optimizing gravel deposition in a subterranean well in accordance with an embodiment of the present invention.

Referring initially to FIG. 1, a system for optimizing gravel deposition in a subterranean well operating from an offshore oil and gas platform is schematically illustrated and generally designated 10. A semi-submersible platform 12 is centered over a submerged oil and gas formation 14 located below sea floor 16. A subsea conduit 18 extends from deck 20 of platform 12 to wellhead installation 22 including blowout preventers 24. Platform 12 has a hoisting apparatus 26 and a derrick 28 for raising and lowering pipe strings such as work string 30.

A well 32 extends through the various earth strata including formation 14. A casing 34 is cemented within a generally vertical portion of well 32 by cement 36. Work string 30 extends beyond the end of casing 34 and includes a series of sand control screen assemblies 38 and a cross-over assembly 40 for gravel packing the generally horizontal open hole completion interval 42 of well 32. When it is desired to gravel pack completion interval 42, work string 30 is lowered through casing 34 such that sand control screen assemblies 38 are suitably positioned within completion interval 42. A control system on the surface then implements a gravel pack deposition plan, as explained in greater detail below, by controlling various characteristics of the gravel packing operation including fluid slurry composition and pumping rates. Thereafter, the fluid slurry including a liquid carrier and a particulate material referred to herein as sand, gravel or proppants is pumped down work string 30.

In one embodiment, the fluid slurry is injected into completion interval 42 through cross-over assembly 40. Once in completion interval 42, the gravel in the fluid slurry is deposited therein using the alpha-beta method wherein gravel is deposited on the low side of completion interval 42 from the near end to the far end of completion interval 42 then in the high side of completion interval 42, on top of the alpha wave deposition, from the far end to the near end of completion interval 42. While some of the liquid carrier may enter formation 14, the remainder of the liquid carrier travels through sand control screen assemblies 38, into a wash pipe (not pictured) and up to the surface via annulus 44 above packer 46. During the treatment operation, sensors positioned within and proximate to completion interval 42 as well as sensors on the surface monitor various parameters associated with the fluid slurry and the gravel packing operations. This data is feed to one or more dynamic gravel pack models that generate estimates of the gravel deposition in completion interval 42. These estimates are provided to the control system to automatically modify the gravel pack deposition plan and optimize the gravel deposition operation. For example, real time changes to various characteristics of the fluid slurry such as sand concentration, fluid viscosity, fluid flow rate and the like can be accomplished to avoid or correct, for example, sand bridging in completion interval 42 and to insure a complete gravel pack within completion interval 42.

Even though FIG. 1 depicts an offshore, open hole, horizontal wellbore and even though the term horizontal is being used to describe the orientation of the depicted wellbore, it should be understood by those skilled in the art that the present invention is equally well suited for use in wellbores having other orientations and configurations including onshore wellbores, cased wellbores, vertical wellbores, inclined wellbores, deviated wellbores, multilateral wellbores and the like. Also, even though a particular gravel packing technique has been referred to with reference to FIG. 1, it should be understood by those skilled in the art that the present invention is equally well suited for use with other gravel packing techniques and other well treatment operations such as fracturing, frac packing, acid or other chemical treatments, resin consolidations, conformance treatments or any other treatment processes involving the pumping of a fluid into a downhole environment wherein it is beneficial to monitor various treatment properties and use this data to regulate the treatment process in real time.

Referring now to FIGS. 2A-2F, these figure depict a horizontal open hole completion interval of a well that is generally designated 50. Casing 52 is cemented within a portion of a well 54 proximate the heel or near end of the horizontal portion of well 54. A work string 56 extends through casing 52 and into the open hole completion interval 58. A packer assembly 60 is positioned between work string 56 and casing 52 at a cross-over assembly 62. Work string 56 includes one or more sand control screen assemblies such as sand control screen assembly 64. Sand control screen assembly 64 includes a base pipe 70 that has a plurality of openings 72 which allow the flow of fluids therethrough.

Wrapped around base pipe 70 is a screen wire 74. Screen wire 74 forms a plurality of turns with gaps therebetween through which fluids flow but which prevent solids of a predetermined sized from passing therethrough. The number of turns and the gap between the turns are determined based upon the characteristics of the formation from which fluid is being produced and the size of the gravel to be used during the gravel packing operation. Screen wire 74 may be wrapped directly on base pipe 70 or may be wrapped around a plurality of ribs (not pictured) that are generally symmetrically distributed about the axis of base pipe 70. It should be understood by those skilled in the art that while a wire wrapped sand control screen is depicted, other types of filter media could alternatively be used in conjunction with the present invention, including, but not limited to, a fluid-porous, particulate restricting, diffusion bonded or sintered metal material such as a plurality of layers of a wire mesh that form a porous wire mesh screen designed to allow fluid flow therethrough but prevent the flow of particulate materials of a predetermined size from passing therethrough.

Disposed within work string 56 and extending from cross-over assembly 62 is a wash pipe assembly 76. Wash pipe assembly 76 extends substantially to the far end of work string 56 near the toe or far end of completion interval 58. In the illustrated embodiment, wash pipe assembly 76 is a composite coiled tubing 78 that includes a series of sensors 80 embedded at predetermined intervals along wash pipe assembly 76 each of which is connected to one of a plurality of energy conductors 82 integrally positioned within composite coiled tubing 78. Sensors 80 may be one or more of a variety of sensor types that are well known to those skilled in the art including pressure sensors, viscosity sensors, temperature sensors, velocity sensors, specific gravity sensors, conductivity sensors, fluid composition sensors and the like.

Even though sensors 80 are depicted as being directly coupled to energy conductors 82, it should be understood by those skilled in the art that sensors 80 could alternatively communicate with energy conductor 82 by other means including, but not limited to, inductive coupling. Also, even though sensors 80 are depicted as being directly coupled to wash pipe assembly 76, sensors 80 or other types of sensors could additionally or alternatively be coupled to sand control screen assembly 64 or otherwise disposed within or proximate to completion interval 58. Further, even though sensors 80 are depicted as being discrete sensors, continuous sensors could additionally or alternatively be deployed external to or internal to sand control screen assembly 64. Such continuous sensors may include, for example, optical fibers operating as distributed temperature sensors.

Any of these sensors including sensors 80 monitor various parameters associated with the fluid slurry and the gravel packing operations such that the data may be used in real time by one or more dynamic gravel pack models of the present invention in generating estimates of the gravel deposition in completion interval 42. These estimates are then provided to the control system to automatically modify, as necessary, the gravel pack deposition plan, thereby optimizing the gravel deposition operation in completion interval 42.

An exemplary alpha-beta gravel packing operation implemented by the system of the present invention will now be described with reference to FIGS. 2B-2F. After the gravel pack deposition plan has been created based upon empirical data, previous operations in similar completions or other techniques, the plan is implemented by the control system. The control system sends commands to various actuators and controllers associated with the constituents of fluid slurry 84 and receives feedback from various sensors associated therewith. For example, commands are sent to various controllers associated with valves, delivery screws, blenders, pumps and the like such that the required constituents, sand, viscosifiers, fluids, liquid additives and the like, may be mixed together to form fluid slurry 84 with the desired composition, in accordance with the gravel pack deposition plan. Fluid slurry 84 is then pumped down the well via the work string at the desired rate, in accordance with the gravel pack deposition plan. Sensors monitor various aspects of the mixing and blending processes as well as the pumping process and feed this information back to the control system for error corrections.

Figure 2A:
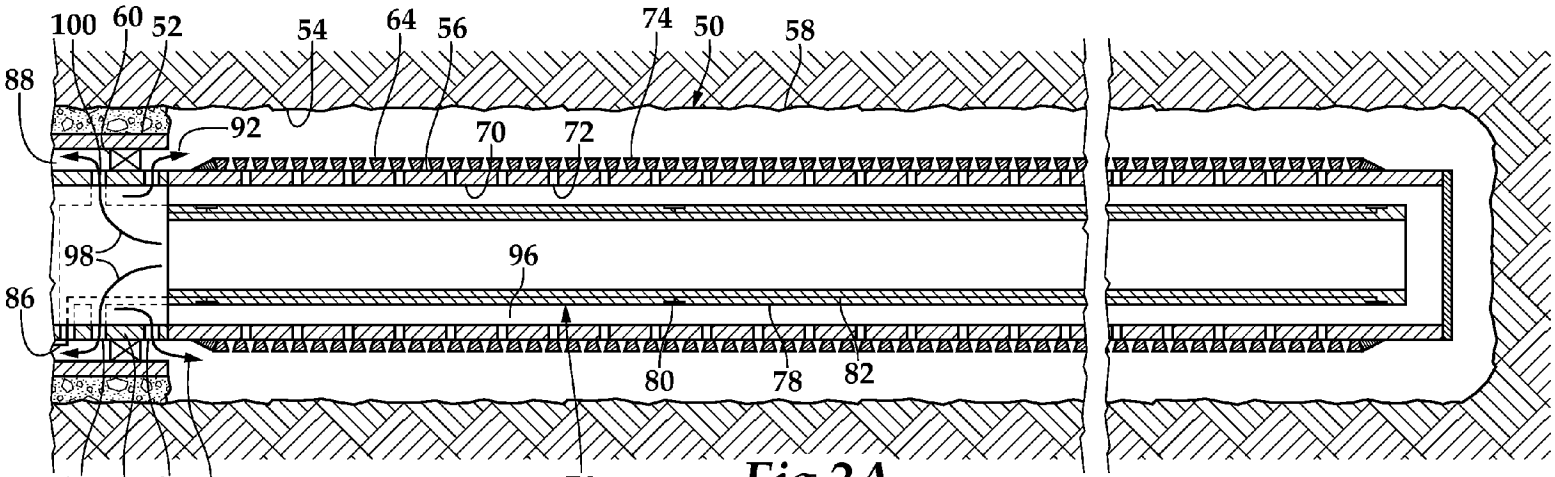
FIG. 2A is a cross sectional view of a completion interval having gravel packing components installed therein including downhole sensors for a system for optimizing gravel deposition in a subterranean well in accordance with an embodiment of the present invention.
Figure 2B:
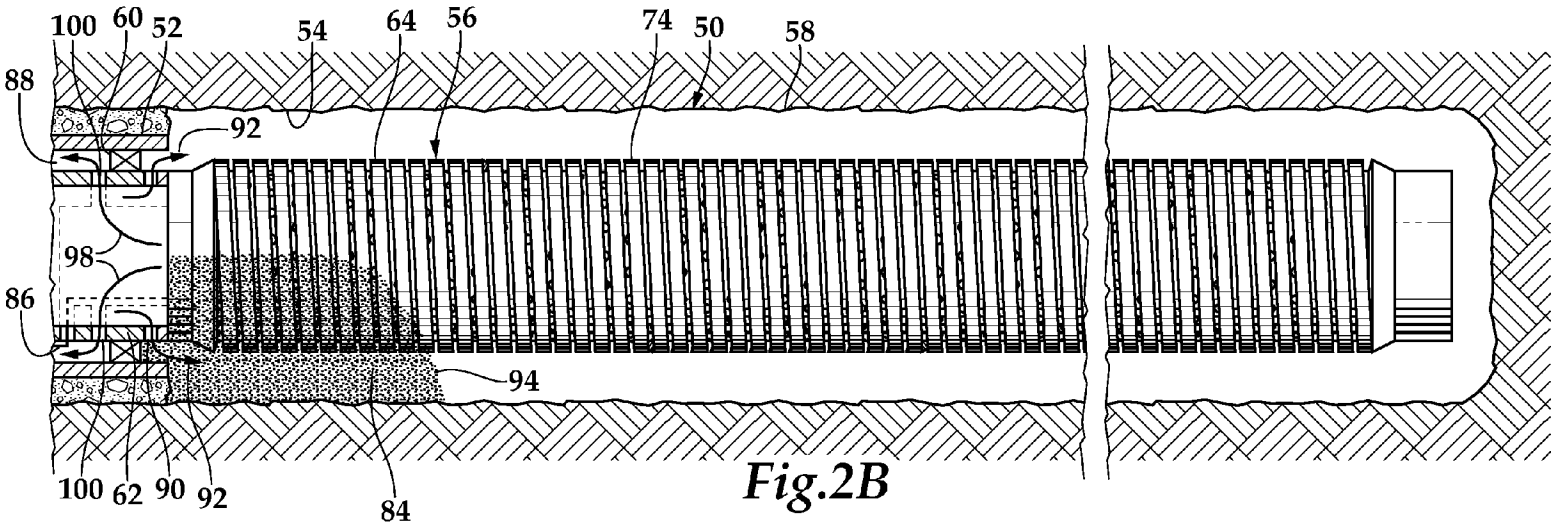
FIGS. 2B-2F are partial cross sectional views of a completion interval depicting various stages of a gravel packing operation using a system for optimizing gravel deposition in a subterranean well in accordance with an embodiment of the present invention.

Once fluid slurry 84 reaches completion interval 58, sensors 80 monitor data relative to various properties of fluid slurry 84 and the downhole environment in completion interval 58. The initial stage of the gravel depositions process is best seen in FIG. 2B. During the gravel depositions process, data obtained by sensors 80 may be relayed to a downhole or surface dynamic gravel pack model to aid the model in making real time estimates of the gravel deposition in completion interval 58. As explained in greater detail below, one or both of these models is used to provide real time control over various properties of fluid slurry 84 and delivery of the same such as fluid viscosity, sand concentration, flow rate and the like. Preferably, communication between sensors 80 and other downhole and surface systems is enabled via energy conductors 82, which may be optical fibers, electrical wires or the like. Communication may alternatively be achieved using a downhole telemetry system such as an electromagnetic telemetry system, an acoustic telemetry system, pressure pulses or other wireless telemetry systems that are known or subsequently discovered in the art. Additionally or alternatively, during the gravel depositions process, data obtained by sensors on the surface may be relayed to a surface dynamic gravel pack model to aid the model in making real time estimates of the gravel deposition in completion interval 58 which are used to provide real time control over various properties of fluid slurry 84 and delivery of the same.

During a gravel packing operation, the objective is to uniformly and completely fill horizontal completion interval 58 with gravel. This is achieved by delivering fluid slurry 84 down work string 56 into cross-over assembly 62. Fluid slurry 84 exits cross-over assembly 62 through cross-over ports 90 and is discharged into horizontal completion interval 58 as indicated by arrows 92. In the illustrated embodiment, fluid slurry 84 then travels within production interval 58 with portions of the gravel dropping out of the slurry and building up on the low side of wellbore 54 from the heel to the toe of wellbore 54 as indicated by alpha wave front 94 of the alpha wave portion of the gravel pack. At the same time, portions of the carrier fluid pass through sand control screen assembly 64 and travel through annulus 96 between wash pipe assembly 76 and the interior of sand control screen assembly 64. These return fluids enter the far end of wash pipe assembly 76, flow back through wash pipe assembly 76 to cross-over assembly 62, as indicated by arrows 98, and flow into annulus 88 through cross-over ports 100 for return to the surface.

Figure 2C:
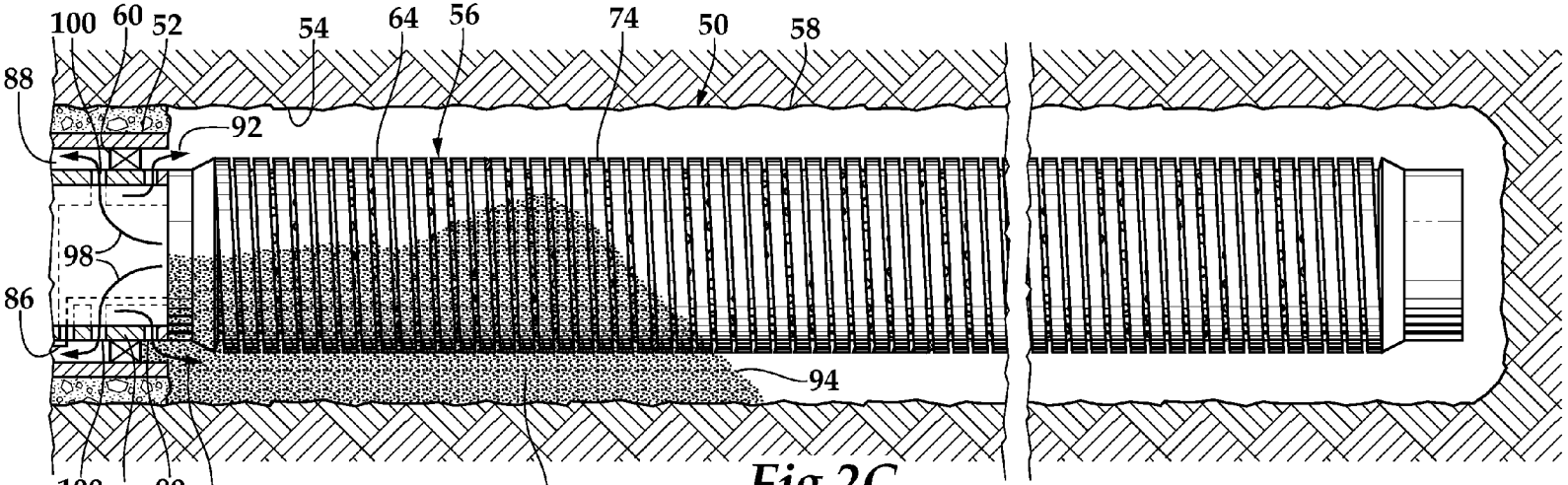

As the propagation of alpha wave front 94 continues from the heel to the toe of horizontal production interval 58, sensors 80 continue monitor and relay data relative to fluid slurry 84 and the downhole environment such as viscosity, temperature, pressure, velocity, fluid composition and the like. As best seen in FIG. 2C, if, for example, excessive leak-off occurs into the formation surrounding completion interval 58, portions of the alpha deposition may build up toward the high side of wellbore 54. The changes in pressure caused by the buildup of the alpha deposition are detectable by sensors 80 as well as surface pressure sensors such that this pressure data is relayed to one of the aforementioned mentioned dynamic gravel pack models. The models then use this data to generate estimates of the gravel deposition. The estimates are then send to the control system such that fluid slurry characteristics such as fluid viscosity, sand concentration, flow rate or the like may be automatically adjusted to correct and prevent undesired sand bridging.

Figure 2D:
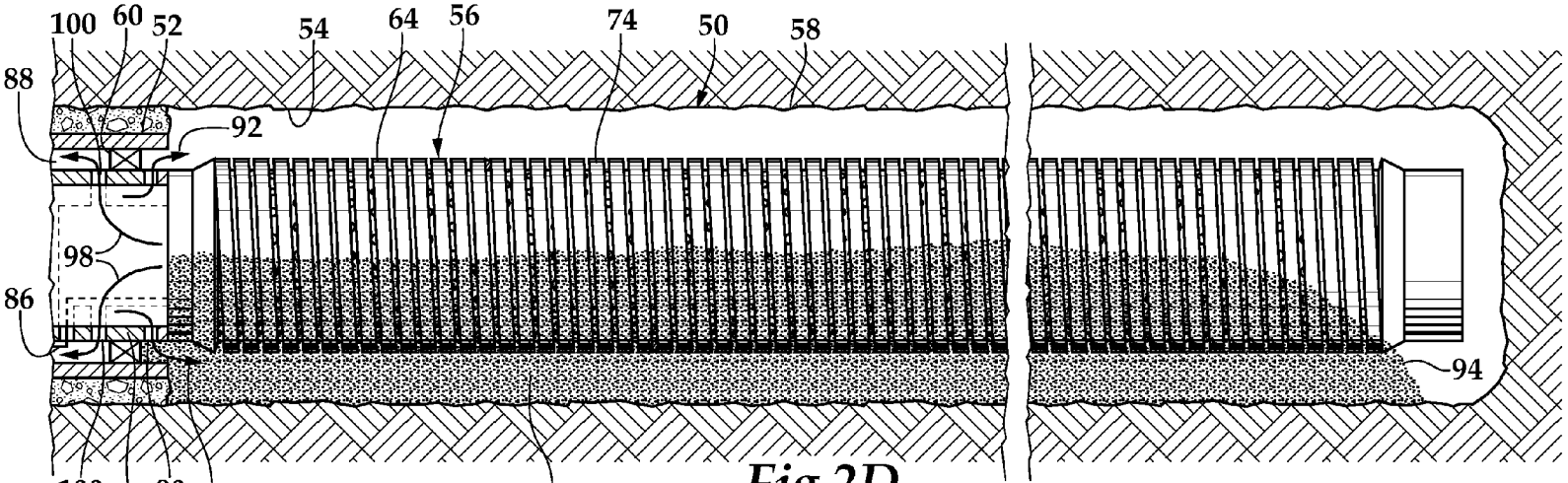
Figure 2E:
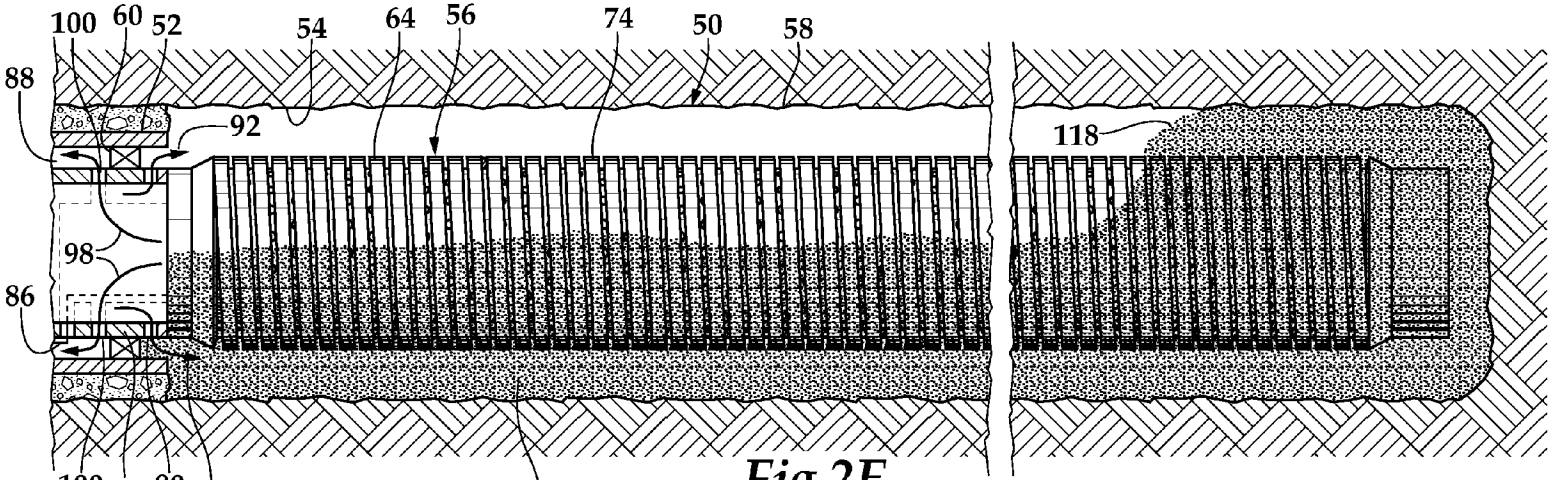
Figure 2F:
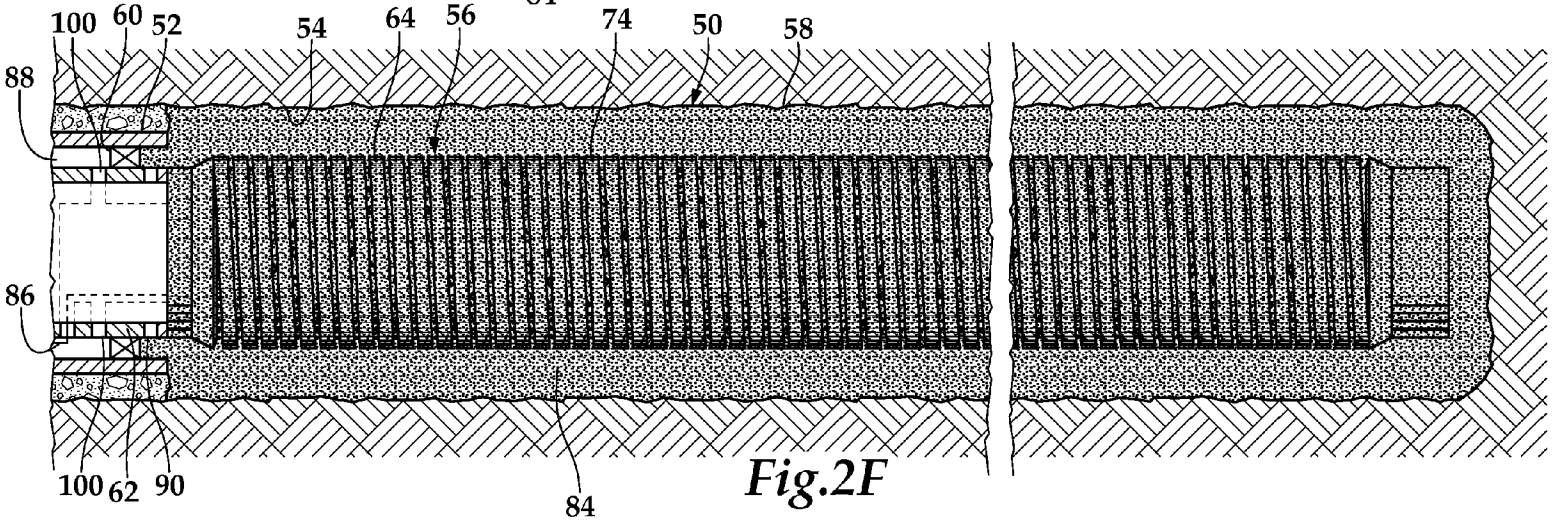

As best seen in FIG. 2D, responsive to the real time indications that the alpha deposition is too high, the composition, flow rate or other characteristic of fluid slurry 84 is automatically adjusted by the optimization system of the present invention so that the height of the alpha deposition can be returned to a desirable level in substantially real time, as illustrated. Hence, by improving the control over gravel placement the present invention insures a more complete gravel pack along the entire length of the completion interval. In particular, the present invention ensures complete gravel packs of long, horizontal wellbores by providing substantially real time identification and correction of gravel deposition problems. As best seen in FIG. 2E, as the beta wave portion of the treatment process progresses, sensors 80 and surface sensors continue to monitor the progress of beta wave front 118, fluid slurry 84 and the wellbore environment and continue to relay the monitored data to one of the dynamic gravel pack models so that the various parameters of fluid slurry 84 may be regulated in real time to ensure a complete gravel pack, as best seen in FIG. 2F.

Figure 3:
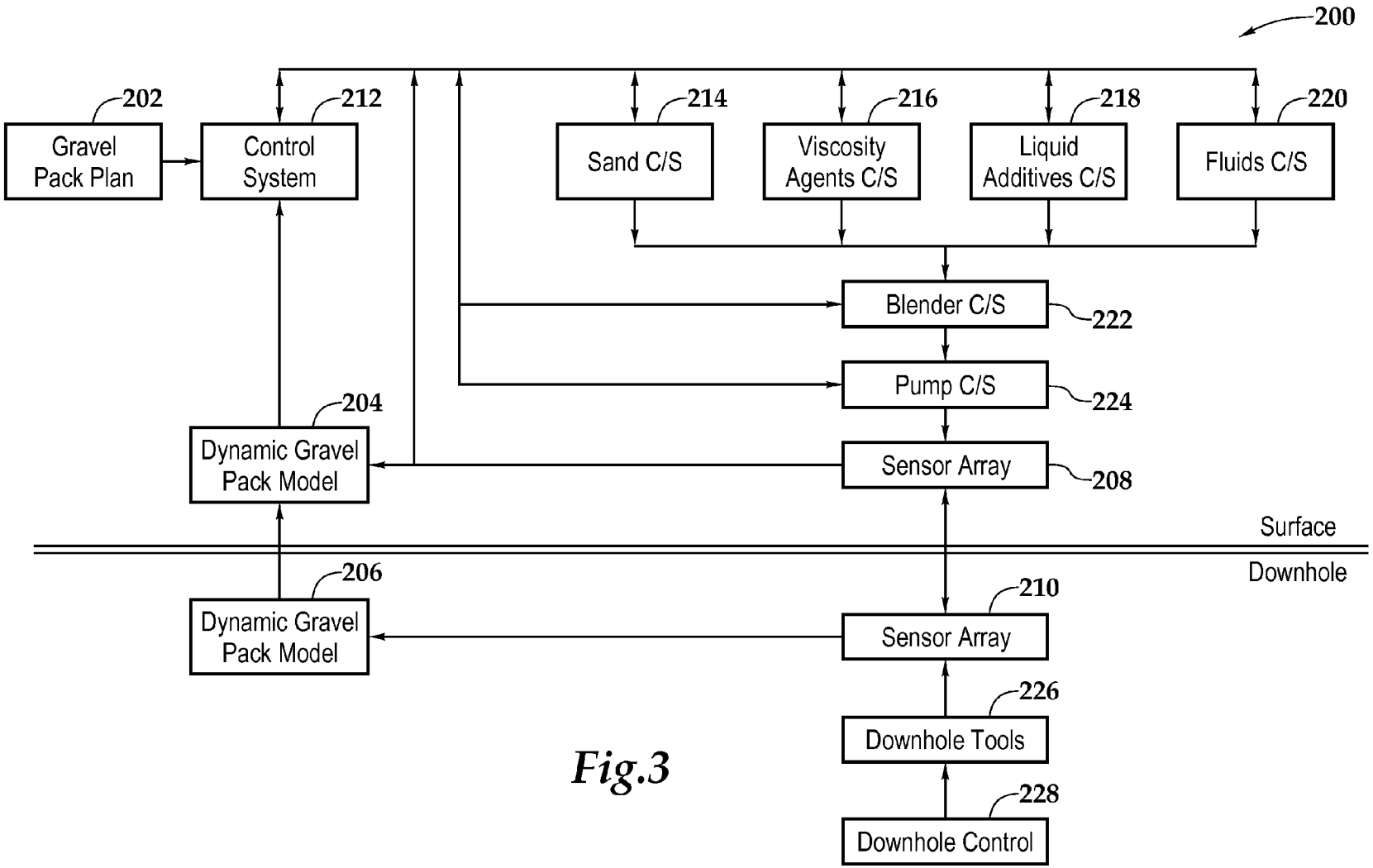
FIG. 3 is a block diagram illustrating surface and downhole systems of a system for optimizing gravel deposition in a subterranean well in accordance with an embodiment of the present invention.

Referring next to FIG. 3, surface and downhole components and processes of the system for optimizing gravel deposition of the present inventions are depicted in block diagram format and generally designated 200. In general, a gravel pack plan 202 is used in conjunction with one or more real time dynamic gravel pack models 204, 206 that estimate gravel deposition in the completion interval to automatically control flow rates and properties of the gravel pack fluid slurry. Real time measurements of various properties representative of gravel deposition are made using sensor array 208 and optional sensor array 210. For example, in certain embodiments, pressure and flow characteristics associated with the fluid slurry and liquid returns can be obtained by sensor array 208 at the surface, which are used by model 204 in making estimates of gravel deposition in the completion interval. These estimates are used in real time to automatically manipulate surface physical components to control the flow rate and properties of the fluid slurry. More specifically, the real time model of gravel deposition is used in determining the error from the desired gravel deposition. The error can be used by a control system 212 to derive various set-points to be used to control the processing equipment delivering the fluid slurry. Real time modifications of the model can be made by comparing sensor measurements of actual gravel deposition parameters to the predicted parameters and then adjusting the model for inaccuracies. Real time updates to the gravel pack plan 202 can be made by comparing actual results to desired results and then adjusting to achieve optimal results.

Successful gravel packing includes achieving a void free pack along the entire length of the completion interval. Accordingly, many factors are considered when preparing the gravel pack plan 202 including wellbore and formation characteristics, including mechanical properties and permeability to fluid flow. The gravel pack plan 202, which is a time based and location based description of the desired gravel deposition in the completion interval, may be developed based upon empirical data, modeling, open loop dynamic prediction, optimization algorithms or other suitable techniques. The gravel pack plan 202 is used by control system 212 to derive the initial set-points to be used to control the processing equipment delivering the fluid slurry. The gravel pack plan 202 is modified in real time based upon by estimates generated by dynamic gravel pack model 204 which provides a time based and location based description of gravel deposition in the completion interval based upon closed loop modeling using fluid behavior models, mass conservation models, gravel deposition models and the like in conjunction with data received from sensor array 208 and optionally, from estimates received from dynamic gravel pack model 206.

In the illustrated embodiment, control system 212 received information from gravel pack plan 202 and dynamic gravel pack model 204. In addition, control system 212 sends commands to and receives feedback from various processing equipment components including sand system 214, viscosity system 216, liquid additive system 218, fluid system 220, blender system 222 and pump system 224. Each of these systems has various controllers and sensors that allow control system 212 to manage each individual component such that control system 212 is able to integrate the entire fluid slurry processing and delivery system to achieve the desired results.

For example, sand controller/sensor 214 represents numerous actuators and monitors associated with achieving desired sand concentration, such as, blender tub level controllers, blender height sensors, blender sand concentration controllers, volumetric sensors, sand screw controllers, blender clean valve controllers and the like. Similarly, viscosity controller/sensor 216 represents numerous actuators and monitors associated with achieving desired fluid slurry viscosity, such as, gel tub level controllers, gel height sensors, gel viscosity controllers, gel screw controllers, gel valve controllers and the like. Likewise, for each liquid additive used in the fluid slurry, liquid additives controller/sensor 218 represents numerous actuators and monitors associated with achieving certain desired fluid slurry properties, such as, liquid additive tub level controllers, liquid additive height sensors, liquid additive controllers, liquid additive valve controllers and the like. Further, fluid controller/sensor 220 represents numerous actuators and monitors associated with fluid input, such as, fluid tub level controllers, fluid height sensors, fluid valve controllers and the like. Also, blender controller/sensor 222 represents numerous actuators and monitors associated with final bending and mixing of the constituent parts of the fluid slurry, such as, level controllers and sensor, speed controllers and sensor, temperature sensors, viscosity sensors, valve controllers and sensors and the like. In addition, pump controller/sensor 224 represents numerous actuators and monitors associated with delivery of the fluid slurry into the well, such as, speed controllers and sensors, temperature sensors, pressure sensors and the like. As such, each of these systems 214, 216, 218, 220, 222, 224 receives commands from and provides feedback to control system 212 to enable the system of the present invention to prepare and deliver a fluid slurry having the desired composition at the desired flow rate as well as modify in real time the composition and flow rate based upon the information from model 204.

The system of the present invention may be integrated with various downhole systems including downhole tool system 226, downhole controllers 228, optional downhole sensor array 210 and optional dynamic gravel pack model 206. As described above with reference to FIG. 2A, downhole tool system 226 includes various tool required for completing the well including service tools, cross over tools, sand control screen assemblies, wash pipe tools and the like. The downhole controllers 228 may include various components for fluid flow control as well as safety systems. The optional downhole sensor array 210 may include various sensors for monitoring gravel deposition including pressure sensors, viscosity sensors, temperature sensors, velocity sensors, specific gravity sensors, conductivity sensors, fluid composition sensors and the like. The optional dynamic gravel pack model 206 is preferably implemented when the optional downhole sensor array 210 is in use. Model 206 provides a time based and location based description of gravel deposition in the completion interval based upon closed loop modeling using fluid behavior models, mass conservation models, gravel deposition models and the like in conjunction with data received from sensor array 210. Preferably, in embodiments that utilize dynamic gravel pack model 206, model 206 communicates with model 204 to provide real time estimates of gravel deposition in the completion interval.

Figure 4:
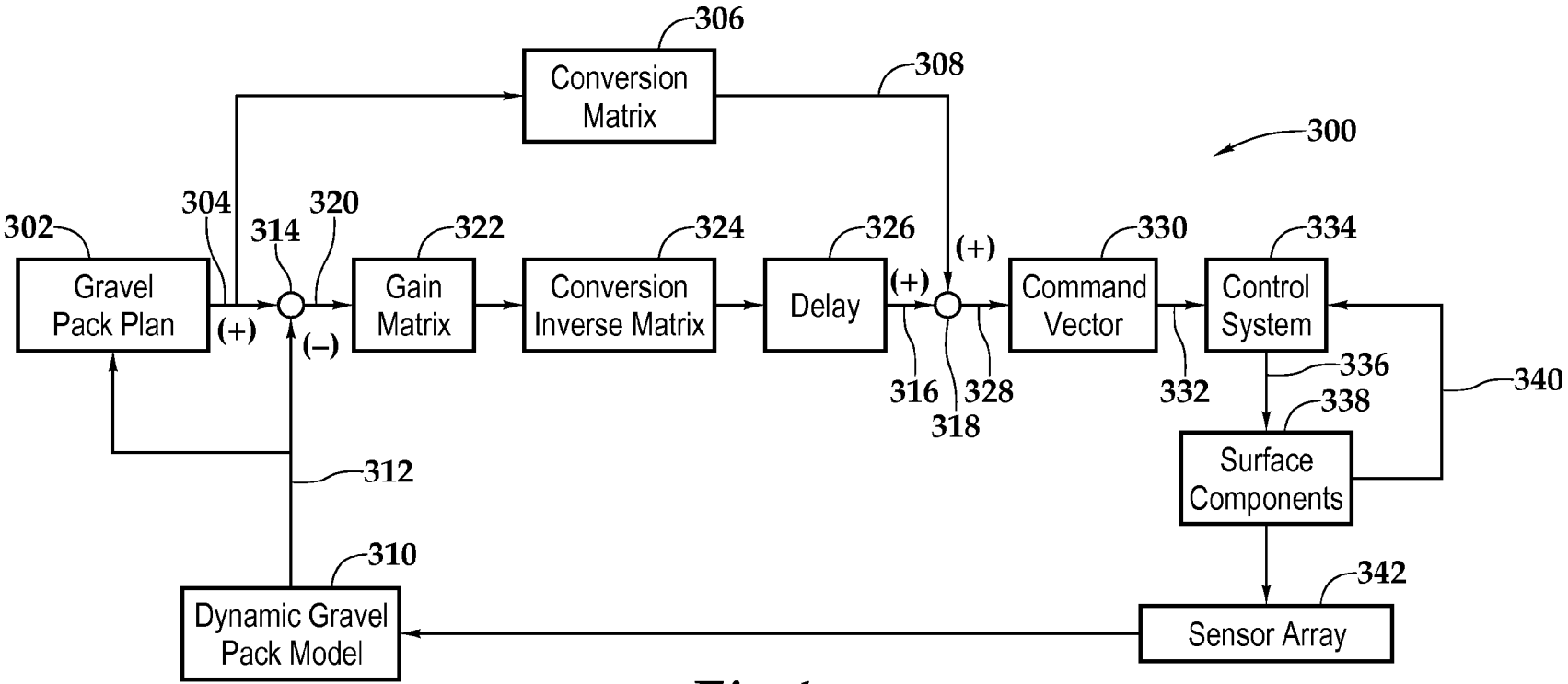
FIG. 4 is a process flow diagram illustrating an embodiment of a system for optimizing gravel deposition in a subterranean well in accordance with the present invention.

Referring now to FIG. 4, therein is depicted a flow diagram of one embodiment of a system for optimizing gravel deposition in a subterranean well in accordance with the present invention that is generally designated 300. System 300 can be used to conduct and control the gravel deposition process being used to gravel pack completion interval 58 as described above with reference to FIGS. 2A-2F. Gravel pack plan 302 is a time based and location based description of the desired gravel deposition in the completion interval and may be developed based upon empirical data, modeling, open loop dynamic prediction, optimization algorithms or other suitable techniques.

In the illustrated embodiment, a gravel deposition signal 304 is output from gravel pack plan stage 302 in the form: $\phi=f(t,z,r)$ where gravel deposition ($\phi$) is a function of time (t), longitudinal position within the completion interval (z) and radial position within the completion interval (r). As such, the gravel deposition function represents the placement of gravel pack sand at point (z, r) at time (t). A conversion matrix 306 uses gravel deposition signal 304 as a feed forward of the gravel pack plan to determine a feed forward of the fluid slurry flow stream properties such as sand concentration, viscosity, liquid additives, fluids and flow rate, as fluid slurry properties signal 308. The gravel pack plan, as gravel deposition signal 304, is compared against the current state estimate from dynamic gravel pack model 310, as state signal 312, in summing stage 314.

The error of the actual state versus the planned state can then be used to provide a correction of the fluid slurry properties, as error signal 316, to summing stage 318. To provide the correction, the output signal 320 of stage 314 can be multiplied by a predetermined gain matrix 322 then processed through conversion inverse matrix 324. In this stage, the inverse of the gravel pack model is used to convert the error correction input to a usable form (e.g. sand concentration, viscosity, liquid additives, fluids, flow rate, etc.) for controlling the fluid slurry properties. Specifically, this stage decouples the cross couple of the states, so that the fluid slurry properties can be controlled independently. The output of conversion inverse matrix 324 is then adjusted by cross coupled temporal delay stage 326. Delay stage 326 ensures all the inputs are driven at the same time context. For example, rate can be changed instantly, but viscosity is delayed by the pipe travel time due to the hold-up of the volume of the well.

The output of stage 318, in the form of the corrected fluid property signal 328, is fed to command vector stage 330 to generate the command vector 332 which is fed to control system 334. As described above with reference to FIG. 3, control system 334 generates various drive signals 336 for controlling surface components 338 that are used to make and deliver the fluid slurry. Control system 334 receives feedback signals 340 from surface components 338 and may include a state feedback decoupling stage to remove nonlinearities.

Dynamic gravel pack model 310, which may include both a surface and a downhole model as discussed above with reference to FIG. 3, is used to estimate the current state of gravel deposition in the completion interval in real time. This estimate is based in part on real time sensor data from sensor array 342, such as those sensors described above as surface sensor array 208 and downhole sensor array 210. Model 310 uses fluid behavior models such as Navier-Stokes equations, mass conservation models, gravel deposition models and the like that are known those skilled in the art, to estimate gravel deposition in the completion interval in relation the rate and volume at which the fluid slurry is pumped as well as the properties of the fluid slurry. Model 310 can also modify itself by comparing actual results of measurements obtained by sensor array 340 to predicted results to correct for any inaccuracies.

Model 310 estimates of the current state of gravel deposition and generates state signal 312 which is used to determine the error in the current state from the planned state in summing stage 314 as described earlier. Model 310 can also supply the same information to allow gravel pack plan 302 to be updated to a new gravel pack plan using an adaptive system within stage 302. Specifically, the gravel pack plan 302 is determined from a desired performance target for the gravel packing operation. The current gravel deposition estimate predicts the resulting performance based on the progress and trends of the current gravel deposition. If the error is above a predetermined value, an adaptive model within gravel pack plan 302 then adjusts the desired gravel deposition over the remaining time for the process to better achieve the desired performance.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A system for optimizing gravel deposition in a completion interval of a well, the system comprising:

a pumping system operable to deliver a gravel pack slurry to the completion interval;

an actuator system operable to control properties of the gravel pack slurry;

a downhole sensor system operable to monitor parameters representative of gravel deposition in the completion interval;

a downhole dynamic gravel pack model defined in a downhole computer that is operable to receive data from the sensor system and provide estimates of gravel deposition in the completion interval;

a surface dynamic gravel pack model defined in a surface computer that is operable to receive estimates from the downhole dynamic gravel pack model and provide estimates of gravel deposition in the completion interval; and a control system operable to control the pumping system and the actuator system in relation to a gravel pack deposition plan and the dynamic gravel pack models, wherein the gravel deposition estimates of the surface dynamic gravel pack model are input into the control system to automatically modify the gravel pack deposition plan.

2. The system as recited in claim 1 wherein the actuator system further comprises an actuator relating to establishing the sand concentration of the gravel pack slurry, an actuator relating to establishing the viscosity of the gravel pack slurry and an actuator relating to inputting at least one liquid additive into the gravel pack slurry.

3. The system as recited in claim 1 wherein the downhole sensor system further comprises sensors selected from the group consisting of a pressure sensor, a viscosity sensor, a temperature sensor, a velocity sensor, a specific gravity sensor, a conductivity sensor and a fluid composition sensor.

4. The system as recited in claim 1 wherein each of the downhole and surface dynamic gravel pack models further comprises a fluid behavior model, a mass conservation model and a gravel deposition model.

5. The system as recited in claim 1 wherein each of the downhole and surface dynamic gravel pack models further comprises a time based and location based description of gravel deposition in the completion interval.

6. The system as recited in claim 1 wherein the gravel pack deposition plan further comprises a time based and location based description of the desired gravel deposition in the completion interval.

7. A method for optimizing gravel deposition in a completion interval of a well, the system comprising:

pumping a gravel pack slurry to the completion interval with a pumping system;

controlling properties of the gravel pack slurry with an actuator system;

monitoring parameters representative of gravel deposition in the completion interval with a downhole sensor system;

receiving data from the sensor system and providing estimates of gravel deposition in the completion interval with a downhole dynamic gravel pack model defined in a downhole computer;

receiving the gravel deposition estimates from the downhole dynamic gravel pack model and providing estimates of gravel deposition in the completion interval with a surface dynamic gravel pack model defined in a surface computer; and controlling the pumping system and the actuator system in relation to a gravel pack deposition plan and the dynamic gravel pack models with a control system by inputting the gravel deposition estimates of the surface dynamic gravel pack model into the control system to automatically modify the gravel pack deposition plan.

8. The method as recited in claim 7 wherein controlling properties of the gravel pack slurry with an actuator system further comprises controlling the sand concentration of the gravel pack slurry, controlling the viscosity of the gravel pack slurry and controlling liquid additive input into the gravel pack slurry.

9. The method as recited in claim 7 wherein monitoring parameters representative of gravel deposition in the completion interval further comprises monitoring parameters selected from the group consisting of pressure, viscosity, temperature, velocity, specific gravity, conductivity and fluid composition.

10. The method as recited in claim 7 wherein providing estimates of gravel deposition in the completion interval with a downhole dynamic gravel pack model further comprises modeling fluid behavior, modeling mass conservation and modeling gravel deposition.

11. The method as recited in claim 7 wherein providing estimates of gravel deposition in the completion interval with a surface dynamic gravel pack model further comprises modeling fluid behavior, modeling mass conservation and modeling gravel deposition.

12. The method as recited in claim 7 wherein providing estimates of gravel deposition in the completion interval with a downhole dynamic gravel pack model further comprises using a time based and location based description of gravel deposition in the completion interval.

13. The method as recited in claim 7 wherein providing estimates of gravel deposition in the completion interval with a surface dynamic gravel pack model further comprises using a time based and location based description of gravel deposition in the completion interval.

14. The method as recited in claim 7 wherein automatically modifying the gravel pack deposition plan further comprises modifying a time based and location based description of the desired gravel deposition in the completion interval.

* * * * *